US006405734B1

(12) United States Patent
Hanada et al.

(10) Patent No.: US 6,405,734 B1
(45) Date of Patent: Jun. 18, 2002

(54) LOW SUB-FLOW SMOKE TYPE CIGARETTE

(75) Inventors: Atsunari Hanada, Yokohama; Masahiko Nagai, Tokyo; Hisashi Ishikawa, Tokyo; Toru Sakurai, Tokyo, all of (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/600,665

(22) PCT Filed: Jan. 19, 1999

(86) PCT No.: PCT/JP99/00162

§ 371 (c)(1),
(2), (4) Date: Jul. 20, 2000

(87) PCT Pub. No.: WO99/35923

PCT Pub. Date: Jul. 22, 1999

(30) Foreign Application Priority Data

Jan. 20, 1998 (JP) ..... 10-008827

(51) Int. Cl.[7] ..... A24D 1/02; D21H 25/00; D21F 11/00

(52) U.S. Cl. ..... 131/365; 131/360; 162/139

(58) Field of Search ..... 131/365, 360; 162/139

(56) References Cited

U.S. PATENT DOCUMENTS 3,228,402 A * 1/1966 Lebert ..... 131/339
4,561,454 A * 12/1985 Guess
5,261,425 A * 11/1993 Raker et al.
5,360,023 A * 11/1994 Blakley et al.
5,415,186 A * 5/1995 Casey, III et al.
5,699,812 A * 12/1997 Bowen et al.
5,724,998 A * 3/1998 Gellatly et al.

FOREIGN PATENT DOCUMENTS

| | | | |
|---|---|---|---|
| JP | A58121786 | * | 7/1983 |
| JP | A3175968 | * | 7/1991 |
| JP | A491776 | * | 3/1992 |
| JP | A4228059 | * | 8/1992 |
| JP | A646817 | * | 2/1994 |
| JP | A6220800 | * | 8/1994 |

* cited by examiner

*Primary Examiner*—Stanley S. Silverman
*Assistant Examiner*—Dionne A. Walls
(74) *Attorney, Agent, or Firm*—Birch, Stewart, Kolasch & Birch, LLP

(57) ABSTRACT

A low-sidestream-smoke cigarette comprises a dual-structure wrapper that wraps filler shreds (5) therein. An inner wrapper (6) of the wrapper is formed of papermaking sheet tobacco or slurry sheet tobacco, while an outer wrapper (8) is ordinary paper. In the case where the inner wrapper (6) is slurry sheet tobacco, the inner wrapper (6) wraps the filler shreds (5) therein so that its smooth surface is situated on the side of the filler shreds (5).

5 Claims, 2 Drawing Sheets

LOW SUB-FLOW SMOKE TYPE CIGARETTE

This application is the national phase under 35 U.S.C. §371 of PCT International Application No. PCT/JP99/00162 which has an International filing date of Jan. 19, 1999, which designated the United States of America.

TECHNICAL FIELD

The present invention relates to a low-sidestream-smoke cigarette capable of producing reduced sidestream smoke when the cigarette is smoked.

BACKGROUND ART

It is known that sidestream smoke from a cigarette can be reduced by lowering the inherent air permeability of the paper of the cigarette. For example, the inherent air permeability of the paper can be lowered by increasing the basic weight thereof.

However, the increase of the basic weight of the paper results in an increase of other pulp components in the entire cigarette than filler shreds, such as shredded tobacco. In this case, the cigarette cannot continue its static burning and worsens its flavor and taste. Moreover, high-basic-weight paper is poor in wrapping property or so-called roll-up property for the filler shreds, so that it is not suited for the production of cigarettes.

According to another known method for reducing the sidestream smoke from cigarettes, paper is loaded with a burning-retardant. This method considerably worsens the flavor and taste of cigarettes.

Further, methods are put to practical use in which magnesium hydroxide or calcium carbonate with a high specific surface area are used as loading materials (fillers) for paper. Since these methods causes the basic weight of the paper to increase, however, the roll-up property for the paper is poor and the flavor and taste is not agreeable. In connection with this, a double-wrapper cigarette is proposed in Jpn. Pat. Appln. KOKAI Publication No. 4-228059. This cigarette is provided with an outer wrapper, which is formed of paper containing a loading material of magnesium hydroxide and having an inherent air-permeability of 15 CORRESTA UNIT or less, and an inner wrapper, which contains tobacco material and has an inherent air-permeability of 50 CORESTA UNIT or more.

In the double-wrapper cigarette described above, the outer wrapper contains magnesium hydroxide, so that the flavor and taste of the cigarette worsens. Since the basic weight of outer wrapper increases, moreover, the outer wrapper has a problem on its roll-up aptitude. Since the inner wrapper has a high inherent air-permeability, furthermore, its effect of sidestream smoke reduction is low.

DISCLOSURE OF THE INVENTION

The present invention has been contrived in consideration of these circumstances, and its object is to provide a low-sidestream-smoke cigarette capable of reducing sidestream smoke without ruining its flavor and taste, combustibility, or roll-up property.

The above object is achieved by a low-sidestream-smoke cigarette of the present invention. This low-sidestream-smoke cigarette comprises a dual-structure wrapper that wraps filler shreds therein. An inner wrapper of the wrapper is formed of permeability-resistant sheet tobacco, while an outer wrapper is formed of cellulose-based paper.

Permeability-resistant implies a low inherent air-permeability. The inherent air-permeability of the inner wrapper ranges from 0.1 to 8.0 CORESTA UNIT, and preferably to 5.0 CORESTA UNIT or less. The cellulose-based paper is paper that is formed of a cellulose base, such as flax pulp or wood pulp, loaded with a filler, such as calcium carbonate, and a burning additive, such as citrates, and may be ordinary cigarette paper that is commercially available.

According to the low-sidestream-smoke cigarette described above, the inner wrapper that is formed of a tobacco sheet is poor in combustibility. Since the outer wrapper is formed of ordinary paper, however, the outer wrapper is high in combustibility and serves as a burning assisting material for the inner wrapper. Thus, the low-sidestream-smoke cigarette can continue its static burning without the possibility of its burning cone dying unexpectedly.

Since the inner wrapper is permeability-resistant sheet tobacco, moreover, its inherent air permeability is low, so that production of sidestream smoke can be reduced considerably.

The sheet tobacco that forms the inner wrapper is paper-making sheet tobacco that is obtained by using the paper making technique or so-called slurry sheet tobacco that is obtained by drying slurry spread over a molding surface.

In the case where slurry sheet tobacco is used as the inner wrapper, the inner wrapper wraps the filler shreds therein in a manner such that its smooth surface on the molding surface side faces the filler shreds. In this case, a rough surface of the inner wrapper on the opposite side defines a large number of air cells between the inner wrapper and the outer wrapper. Air in these cells facilitates combustion of the inner wrapper, so that the static burning of the low-sidestream-smoke cigarette can be maintained securely.

The inner wrapper, which is formed of sheet tobacco, never worsens the flavor and taste during smoking, and inner wrapper itself can be flavored with ease.

Since the inner wrapper is formed of sheet tobacco, moreover, the inner wrapper as well as the outer wrapper is higher in roll-up property than paper that contains special additives.

Preferably, the respective basic weights and inherent air-permeability of the inner and outer wrappers are set as follows.

The basic weight and inherent air-permeability of the inner wrapper range from 30 to 80 g/m$^2$ and from 0.1 to 8.0 CORESTA UNIT, respectively, and the basic weight and inherent air-permeability of the outer wrapper range from 15 to 30 g/m$^2$ and from 15 to 100 CORESTA UNIT, respectively.

If the respective basic weights of the inner and outer wrappers are within the ranges described above, satisfactory roll-up properties can be secured for the inner and outer wrappers. Even if the air-permeability of the outer wrapper is large, since the air-permeability of the inner wrapper is within the aforesaid range, moreover, the air-permeability of the inner and outer wrappers as a whole is lowered, so that sidestream smoke can be reduced considerably.

Preferably, the inner wrapper is embossed at least partially. In this case, embossing the inner wrapper causes the substantial thickness of the inner wrapper to increase, which is conducive to the curtailment of shredded tobacco, and in consequence, to the reduction of production of sidestream smoke.

Preferably, moreover, the production of sidestream smoke from each cigarette is 10 mg or less, the speed of production of the sidestream smoke is 1.0 mg/min or less, and the tar content of each cigarette is 6 mg or less. In this case, low-sidestream-smoke cigarettes with reduced sidestream smoke and a light flavor and taste can be obtained.

BEST MODE FOR CARRYING OUT THE INVENTION

Figure 1:
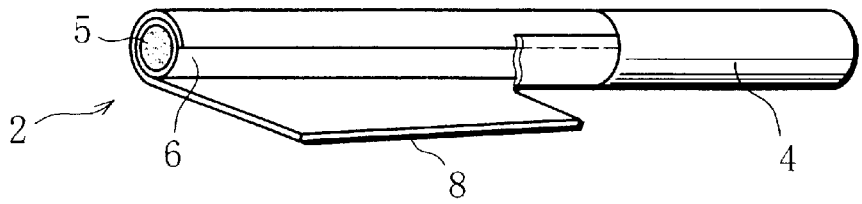
FIG. 1 is a cutaway perspective view showing a filter cigarette according to one embodiment.

Referring to FIG. 1, there is shown a filter cigarette. This filter cigarette is formed of a cigarette 2 and a filter tip 4 that is connected to one end of the cigarette 2 by means of tip paper, and its tar content ranges from 1 g to 10 mg, and preferably at 6 mg or less.

The cigarette 2 comprises filler shreds 5, mainly made of shredded tobacco, and a wrapper that wraps therein the filler shreds 5 in the form of a rod, the wrapper having a dual structure. More specifically, the wrapper includes an inner wrapper 6 that directly wraps the filler shreds 5 therein and an outer wrapper 8 that covers the outside of the inner wrapper 6.

The inner wrapper 6 is formed of permeability-resistant sheet tobacco that has low inherent air permeability. This sheet tobacco is papermaking sheet tobacco that is obtained by the skimming method or slurry sheet tobacco that is obtained by drying slurry.

Figure 2:
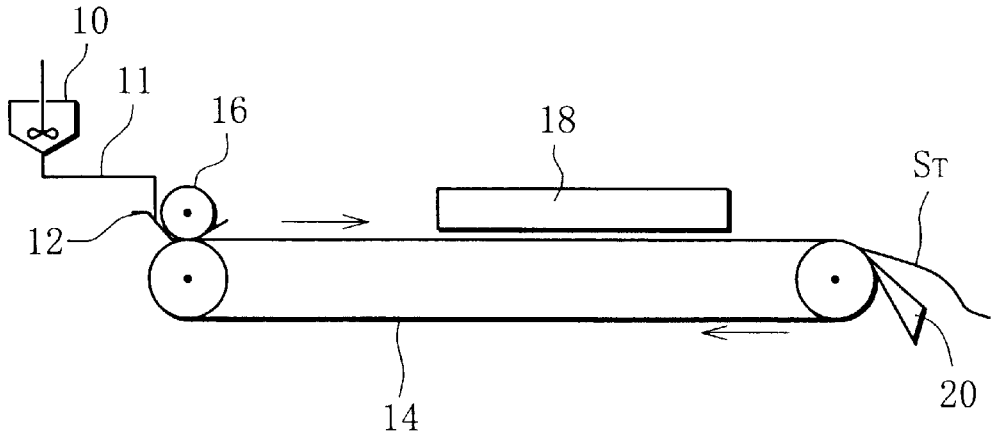
FIG. 2 is a schematic view showing a sheet tobacco manufacturing apparatus.
Figure 3:
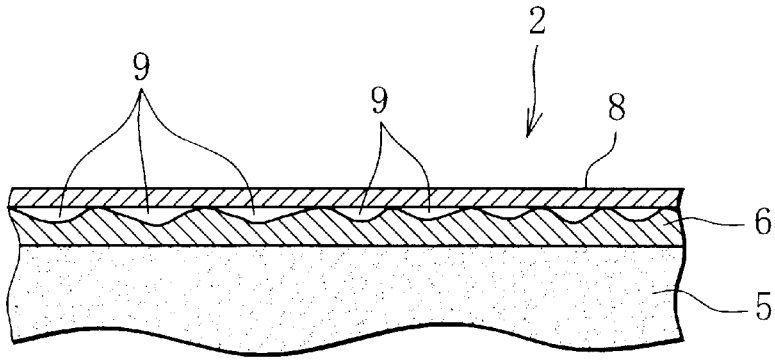
FIG. 3 is a partial enlarged view of the filter cigarette of FIG. 1.

Referring to FIG. 2, there is shown an example of an apparatus for manufacturing slurry sheet tobacco. This manufacturing apparatus supplies raw material or slurry from a slurry tank 10 to a slurry Supplier 12 through a supply pipe 11. The slurry is obtained by adding tobacco powder and binder containing composite polysaccharide to wood pulp that is mixed and fibrillated in water, and mixing them.

The slurry in the slurry supplier 12 is extruded from between a belt conveyor 14 and a roller 16, and is spread like a sheet over the belt conveyor 14. Thereafter, the sheetlike slurry on the belt conveyor 14 is dried to become slurry sheet tobacco $S_T$ as it passes through a drying oven 18. The slurry sheet tobacco $S_T$ is separated from surface of the belt conveyor 14 by means of a doctor blade 20.

Since the slurry sheet tobacco $S_T$ is molded on the belt conveyor 14, as mentioned before, its surface on the side of the belt conveyor 14 is a smooth surface that is smoother than the other surface. When the slurry sheet tobacco $S_T$ is used as the inner wrapper 6, the inner wrapper 6 wraps the filler shreds 5 therein with its smooth surface inward or facing the filler shreds 5. Thus, the rough surface of the inner wrapper 6 on the other side defines a large number of air cells 9 between the inner wrapper 6 and the outer wrapper 8.

The basic weight of the inner wrapper 6, whether it is formed of papermaking sheet tobacco or slurry sheet tobacco, ranges from 30 to 80 g/m$^2$, and the inherent air permeability of inner wrapper 6 ranges from 0.1 to 8.0 CORESTA UNIT.

If the basic weight of the inner wrapper 6 deviates from the aforesaid range, the stiffness of the inner wrapper 6 may be too low or too high, so that its roll-up property lowers. If the inherent air permeability of the inner wrapper 6 increases beyond the aforesaid range, moreover, sidestream smoke cannot be reduced satisfactorily.

On the other hand, the outer wrapper 8 is formed of ordinary cigarette paper that is used for conventional cigarettes. The ordinary cigarette paper is paper that contains none of special chemicals, additives, etc. that serve to reduce sidestream smoke. More specifically, the outer wrapper 8 is formed of a cellulose base, an inorganic filler material such as calcium carbonate, and a burning additive such as citrates, and its inherent air-permeability and basic weight range from 15 to 100 CORESTA UNIT and from 15 to 30 g/m$^2$, respectively.

Cigarettes of examples and references shown in TABLE 1 below were used to compare filter cigarettes of the present invention with filter cigarettes using ordinary cigarette paper only and filter cigarettes using low-sidestream-smoke paper that contains special chemicals and additives, with respect to the production of sidestream smoke from the cigarettes.

TABLE 1

| Sample | Inner Wrapper | Outer Wrapper |
|---|---|---|
| Example 1 | Sheet Tobacco | Medium-Permeability Paper |
| Example 2 | Sheet Tobacco | High-Permeability Paper |
| Reference 1 | Sheet Tobacco | Low-Sidestream-Smoke Paper |
| Reference 2 | None | High-Permeability Paper |
| Reference 3 | None | Medium-Permeability Paper |

Here the sheet tobacco is slurry sheet tobacco. The medium- and high-permeability papers are obtained by mixing flax pulp, calcium carbonate, and titanium oxide, and their surface is coated with 1 wt % of citrate (Na:K=7:3) for use as a burning additive. The low-permeability paper is obtained by mixing flax pulp, calcium carbonate, and calcined clay, and its surface is coated with 1 wt % of citrate (Na:K=7:3) for use as a burning additive. The length and peripheral length of each of cigarette portions of the examples and the references are 59 mm and 25 mm, respectively.

TABLE 2 below shows the physical properties of the aforesaid inner and outer wrappers.

TABLE 2

| Inner/ Outer Wrapper | Basic Weight (mg/m$^2$) | Thickness (μm) | Air-Permeability (CU) | Inorganic Filler (wt %) Calcium Carbonate | Inorganic Filler (wt %) Others | Burning Additive |
|---|---|---|---|---|---|---|
| Sheet Tobacco | 64.0 | 113 | 1 | 25 | 1% of titanium oxide | 1% of citrate |

TABLE 2-continued

| Inner/ Outer Wrapper | Basic Weight ($mg/m^2$) | Thickness ($\mu m$) | Air-Permeability (CU) | Inorganic Filler (wt %) Calcium Carbonate | Others | Burning Additive |
|---|---|---|---|---|---|---|
| Medium-Permeability Paper | 21.0 | 33 | 18 | 25 | 1% of titanium oxide | 1% of citrate |
| High-permeability Paper | 25.0 | 46 | 91 | 25 | 1% of titanium oxide | 1% of citrate |
| Low-Sidestream-Paper | 45.4 | 57 | 2 | 29 | 10% of calcined clay | 1% of citrate |

Figure 4:
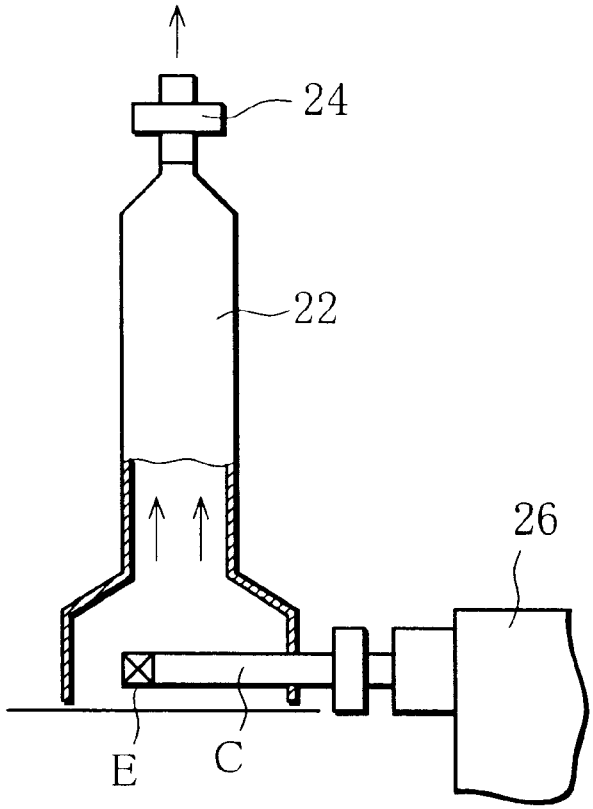
FIG. 4 is a schematic view of a fishtail collector.

The production of sidestream smoke was measured on Examples 1 and 2 and References 1 and 2 by using a fishtail collector. The fishtail collector, which is shown in FIG. 4, is provided with a chimney-shaped collector body 22. A Cambridge filter 24 is mounted on the upper end of the collector body 22, and a socket for filter cigarettes C of the examples and the references is provided in the lower end. Each of the filter cigarettes C of the examples and the references is attached to a smoking machine 26. After the filter cigarette C is lighted, the smoking machine 26 automatically smokes the filter cigarette C under standard smoking conditions. Here the standard smoking conditions include a puff cycle that is defined by a sucking operation at 35 cc/2 sec and a suspension period of 58 seconds thereafter. This puff cycle is repeated so that the combustion length reaches 51 mm.

During the automatic smoking described above, the collector body 22 sucks in sidestream smoke from a combustion end E of the filter cigarette C, along with air, toward the Cambridge filter 24 under the condition of 31/min. The automatic smoking and the suction of the sidestream smoke described above are repeated for a given test number of filter cigarettes C.

Thereafter, change of the weight of the Cambridge filter 24 is measured, and a first weight of particle layer components of the sidestream smoke, adhering to the Cambridge filter 24 is calculated. After particle layer components of the sidestream smoke, which have been adhered to the Cambridge filter 24 and the collector body 22 are extracted individually, their respective absorbances are measured individually. Based on the ratio between the absorbances and the first weight, a second weight of the particle layer components adhering to the collector body 22 is calculated. The sum of the first and second weights is divided by the test number of filter cigarettes C, thereupon a first production (mg/cig) of sidestream smoke for each cigarette C is calculated. Further, a second production (mg/min), which is indicative of the speed of production of sidestream smoke, is calculated by dividing the first production by combustion time required by the automatic smoking.

The aforesaid smoking test was conducted for the same test number of filter cigarettes for Examples 1 and 2 and References 1 to 3. TABLE 3 below shows the rate of reduction of sidestream smoke calculated according to Reference 3 with respect to the production of sidestream smoke.

TABLE 3

| | Number of Puffs (times) | Combustion Time (sec) | Production of Sidestream Smoke: Per Cigarette (mg/cig) | Reduction Rate (%) | Per Unit Time (mg/min) | Reduction Rate (%) |
|---|---|---|---|---|---|---|
| Example 1 | 11.0 | 628 | 6.3 | 69.0 | 0.618 | 77.6 |
| Example 2 | 9.8 | 534 | 6.5 | 68.0 | 0.728 | 73.6 |
| Reference 1 | 10.8 | 603 | 5.3 | 73.9 | 0.528 | 80.8 |
| Reference 2 | 12.3 | 709 | 15.3 | 24.5 | 1.297 | 52.9 |
| Reference 3 | 8.0 | 443 | 20.3 | — | 2.754 | — |

In the cases of Reference 1 and Examples 1 and 2, compared with Reference 3, as seen from TABLE 3, the rates of reduction of sidestream smoke per cigarette and per unit time are high enough, that is, the production of sidestream smoke from each cigarette is reduced to 10 mg or less, and the speed of production to 1.0 m/min or less. When Reference 1 is compared with Examples 1 and 2, Reference 1 proves to be higher in the rate of reduction of sidestream smoke. Using the low-sidestream-smoke paper, however, Reference 1 is inferior in flavor and taste and roll-up property.

In the low-sidestream-smoke cigarettes of Examples 1 and 2, the slurry sheet tobacco is used for their inner wrapper. It is to be understood, however, that the same result of TABLE 3 can be obtained in the case of a low-sidestream-smoke cigarette that uses papermaking sheet tobacco for the inner wrapper 6.

TABLE 4 below collectively shows properties of other references as well as those of Examples 1 and 2 and References 1 to 3.

TABLE 4

| | Reduction of Sidestream Smoke | Flavor and Taste | Static Burning | Curtailment of Shredded Tobacco | Roll-up Property |
|---|---|---|---|---|---|
| Example 1 | ⊙ | ○ | ○ | ○ | ○ |
| Example 2 | ⊙ | ○ | ○ | ○ | ○ |
| Reference 1 | ⊙ | Δ | ○ | ○ | Δ |
| Reference 2 | X | ○ | ○ | X | ○ |
| Reference 3 | X | ○ | ○ | X | ○ |
| Reference 4 | ⊙ | ⊙ | X | Δ | ○ |
| Reference 5 | ○ | Δ | ○ | ○ | ○ |
| Reference 6 | ○ | Δ | ○ | ○ | ○ |
| Reference 7 | ○ | Δ | ○ | ○ | Δ |
| Reference 8 | ○ | X | Δ | Δ | Δ |

In TABLE 4, ⊙, ○, Δ and X represent excellent, good, unsatisfactory, and poor properties, respectively. TABLE 5 below shows wrappers used in References 4 to 8.

TABLE 5

| | Inner Wrapper | Outer Wrapper |
|---|---|---|
| Reference 4 | None | Sheet Tobacco |
| Reference 5 | High-Permeability Sheet Tobacco | High-Permeability Paper |
| Reference 6 | High-Permeability Sheet Tobacco | Medium-Permeability Paper |
| Reference 7 | High-Permeability Sheet Tobacco | Low-Sidestream-Smoke Paper |
| Reference 8 | None | Low-Sidestream-Smoke Paper |

The high-permeability sheet tobacco used in the respective inner wrappers of References 5 to 7 is higher enough in inherent air permeability than the inner wrappers 6 of Examples 1 and 2, the inherent air permeability ranging from 10 to 380 CORESTA UNIT, for example.

As seen from TABLE 4, the low-sidestream-smoke cigarettes of Examples 1 and 2 are excellent in flavor and taste, static burning, curtailment of shredded tobacco, and roll-up property, as well as in the effect of sidestream smoke reduction.

The static burning will now be described in detail. The outer wrapper 8, which is formed of ordinary cigarette paper, functions as a burning assisting material for the inner wrapper 6 that is formed of sheet tobacco. In the case where the inner wrapper 6 is formed of the slurry sheet tobacco, as mentioned before, moreover, a large number of air cells 9 are secured between the inner wrapper 6 and the outer wrapper 8. Therefore, air in these cells 9 is utilized for the combustion of the inner wrapper 6, so that the combustibility of the inner wrapper 6 is improved further. In consequence, the low-sidestream-smoke cigarettes can securely continue its static burning.

The curtailment of shredded tobacco means a reduction of the fill of the filler shreds 5 in the cigarette 2. More specifically, the whole wrapper of each of the low-sidestream-smoke cigarettes 2 of Examples 1 and 2 has a dual structure, and its inner wrapper is formed of high-stiffness sheet tobacco, so that the cigarette 2 can be solid to the touch. Thus, the surface hardness of the cigarette 2 increases, so that the fill of the filler shreds 5 that is needed to secure the surface hardness of the cigarette 2 can be reduced correspondingly.

The cigarettes of Examples 1 and 2 are excellent in roll-up property for the inner and outer wrappers, so that they can enjoy high productivity and can be low-sidestream-smoke cigarettes that are excellent in the curtailment of shredded tobacco and in flavor and taste.

As seen from TABLE 4, Reference 4 is poor in the maintenance of static burning, and besides, it is not a smoking article that belongs to the category of a cigarette.

Although References 5 to 7 that use high-permeability sheet tobacco for their inner wrappers can reduce sidestream smoke in some measure, as seen from TABLE 4, the resulting effect is inferior because they are higher in the air-permeability than the inner wrappers 6 of Examples 1 and 2. In References 5 to 7, air easily permeates the inner wrapper, so that the flavor and taste of the inner wrapper 6 and the filler shreds 5 is diluted with the air. Thus, these references are also poorer in flavor and taste than Examples 1 and 2. In Reference 7, moreover, the outer wrapper is formed of low-sidestream-smoke paper, so that its roll-up property is poorer.

Although Reference 8 of which the wrapper is formed of low-sidestream-smoke paper only produces some effect with respect to the reduction of sidestream smoke only, it is poorer in other properties.

Figure 5:
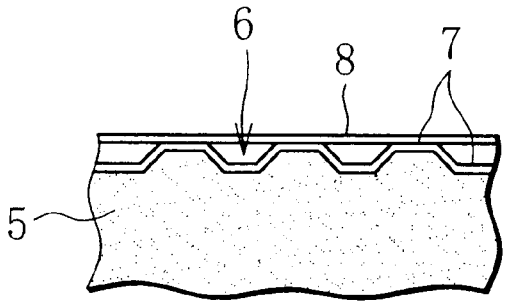
FIG. 5 is a partial sectional view of a cigarette having its inner wrapper embossed.

In the low-sidestream-smoke cigarette of the present invention, the inner wrapper 6, whether it is formed of papermaking sheet tobacco or slurry sheet tobacco, can be improved further. Since the inner wrapper 6 is higher in the basic weight than ordinary cigarette paper and is thick enough, its whole area can be easily embossed, as shown in FIG. 5. Since indentations 7 formed by this embossing increase the thickness of the inner wrapper 6, the fill of the filler shreds can be reduced further. In consequence, the production of sidestream smoke, as well as the total cost of manufacture of filter cigarettes, can be lowered.

Since the embossed inner wrapper 6 is properly increased in softness, its roll-up property can be improved without ruining the tough feeling of the cigarette.

Further, the inner wrapper 6, embossed in this manner, is excellent in the effect of frictional engagement with the filler shreds 5, and serves to prevent the filler shreds 5 from slipping off from the cut end of the cigarette or the so-called tip dropping. In order to prevent only the tip dropping of the filler shreds 5, only that region of the inner wrapper 6 which is situated at the tip end portion of the cigarette should be embossed.

What is claimed is:

1. A low-sidestream-smoke cigarette comprising:

filler shreds including shredded tobacco;

an inner wrapper formed of reconstituted tobacco and wrapping said filler shreds therein, said inner wrapper having a basic weight and a first air-permeability; and an outer wrapper covering the outside of said inner wrapper and formed of cellulose-based paper, said outer wrapper having a basic weight and a second air-permeability higher than the first air-permeability of said inner wrapper, wherein the basic weights of said inner and outer wrappers range from 30 to 80 g/m$^2$ and from 15 to 30 g/m$^2$, respectively, and the first and second air-permabilities range from 0.1 to 8.0 CORESTA UNIT and from 15 to 100 CORESTA UNIT, respectively, wherein a ratio of the first air-permeability to the second air-permeability ranges from 0.1/100 to 8/15.

2. The low-sidestream-smoke cigarette according to claim 1, wherein said inner wrapper is a slurry sheet tobacco having an inner surface which faces said filler shreds and an outer surface, the inner surface being smoother than the outer surface.

3. The low-sidestream-smoke cigarette according to claim 1, wherein said inner wrapper has a region embossed at least partially.

4. The low-sidestream-smoke cigarette according to claim 1, wherein when said cigarette is smoked under the standard smoking conditions, generation of sidestream smoke from said cigarette is 10 mg or less, and the rate of generation of the sidestream smoke is 1.0 mg/min or less.

5. The low-sidestream-smoke cigarette according to claim 1, wherein a tar content of said cigarette is 6 mg or less.

* * * * *